US005323168A

United States Patent [19]

Itoh et al.

[11] Patent Number: 5,323,168

[45] Date of Patent: Jun. 21, 1994

[54] DUAL FREQUENCY ANTENNA

[75] Inventors: Munehiko Itoh, Nara, Japan; Masao Arakawa, Cupertino, Calif.; Raj Mittra, Champaign, Ill.

[73] Assignee: Matsushita Electric Works, Ltd., Kadoma, Japan

[21] Appl. No.: 912,532

[22] Filed: Jul. 13, 1992

[51] Int. Cl.[5] ..... H01Q 1/38

[52] U.S. Cl. ..... 343/700 MS; 343/769; 343/830

[58] Field of Search ..... 343/700 MS, 767, 768, 343/769, 829, 846, 847, 830; H01Q 1/38

[56] References Cited

U.S. PATENT DOCUMENTS

| | | | |
|---|---|---|---|
| 2,287,220 | 6/1923 | Alford | 250/33 |
| 2,362,561 | 12/1940 | Katzin | 250/11 |
| 2,398,096 | 4/1946 | Katzin | 250/11 |
| 2,479,227 | 11/1945 | Gilbert | 250/33 |
| 3,541,557 | 6/1968 | Miley | 343/746 |
| 3,739,386 | 6/1973 | Jones, Jr. | 343/708 |
| 3,803,623 | 4/1974 | Charlot | 343/846 |
| 3,971,032 | 7/1976 | Munson | 343/770 |
| 4,060,810 | 11/1977 | Kerr | 343/700 |
| 4,089,003 | 5/1978 | Conroy | 343/700 |
| 4,131,892 | 12/1978 | Munson | 343/700 |
| 4,131,893 | 12/1978 | Munson | 343/700 |
| 4,218,682 | 8/1980 | Yu | 343/700 |
| 4,320,402 | 3/1982 | Bowen | 343/700 MS |
| 4,821,040 | 4/1989 | Johnson et al. | 343/700 MS |
| 4,987,421 | 1/1991 | Sunahara et al. | 343/700 MS |

OTHER PUBLICATIONS

Bahl et al., "Microstrip Antennas," Artech House, 1984, pp. 1-29 et seq.

Howell, "Microstrip Antennas," IEEE Trans. on Antennas etc., pp. 90-93.

Munson, "Microstrip Antennas," Antenna Engineering Handbook, pp. 7-1 to 7-28.

*Primary Examiner*—Donald Hajec
*Assistant Examiner*—Hoanganh Le
*Attorney, Agent, or Firm*—Hickman & Beyer

[57] ABSTRACT

Antenna apparatus for receiving two distinct frequencies in the MHz or GHz range. A resonator layer of electrically conducting material is positioned in the interior of a dielectric layer that has first and second opposed surfaces (front and back). First and second ground planes are positioned on the first and second opposed surfaces of the substrate. The resonator is electrically connected to an annular strip of conducting material, positioned on the first substrate surface and surrounding the first ground plane. Two receiver feed connections, positioned at selected first and second positions on the patch resonator, receive distinct first and second frequencies. This apparatus may be used to receive the two GPS operating frequencies, the two GLONASS operating frequencies or two wireless LAN operating frequencies.

34 Claims, 4 Drawing Sheets

DUAL FREQUENCY ANTENNA

BACKGROUND OF THE INVENTION

This invention relates to dual frequency antennas for receipt and/or transmission of electromagnetic signals.

Many telecommunication systems in use today require use of multiple frequencies for proper operation. For example, the Global Positioning System (GPS) implemented by the U.S. Government requires use of two frequencies, 1.227 GHz and 1.575 GHz, in order to compensate for some of the effects of frequency-dependent ionospheric delay on propagation of electromagnetic signals through the ionosphere. For similar reasons, the GLONOSS global positioning and navigation system of the former Soviet Union uses two frequencies, 1.246 GHz and 1.602 GHz. One design of a wireless Local Area Network (LAN) uses three frequency ranges, 0.902–0.928 GHz, 2.400–2.485 GHz and 5.725–5.850 GHz, for control and data transmission purposes. Use of multiple frequencies may require use of multiple antennas, which may create space allocation problems in a transmitter or receiver with a size constraint imposed.

Microstrip antennas, which were first discussed by G. A. Deschamps in "Microstrip Microwave Antennas", "Third U.S.A.F. Symposium on Antennas", 1953, offer a possible solution to the size problem for multiple antennas. These antennas have been discussed in more detail by J. Q. Howells in "Microstrip Antennas", I.E.E.E. Trans. on Antennas and Propagation, 1975, pp. 90–93; by R. E. Munson in "Microstrip Antennas", in *Antenna Handbook*, edited by Skolia, pp. 7-1 to 7-28; and by I. J. Bahl and P. Bhartia, Microstrip Antennas, Artech House, 1984, pp. 1–29 et seq.

A microstrip (ms) antenna, in its simplest form, consists of a thin electromagnetic resonator layer of carefully chosen dimensions, a ground plane, a dielectric layer contiguous to and separating the resonator and the ground plane, and an antenna signal feed connected to the resonator at a carefully chosen position. Microstrip antennas are available as patch antennas, as traveling wave antennas and as slot antennas, depending upon the geometry chosen for the resonator. These types of ms antennas are discussed and contrasted by Bahl and Bhartia, op. cit. A ms antenna offers several advantages relative to conventional antennas: (1) the ms antenna size is quite small, having typical dimensions of the order of 10 cm×10 cm×1 cm; (2) fabrication cost of a ms antenna is low for high volume production; (3) a ms antenna has low scattering cross-section; (4) linear, as well as circular (right hand or left hand) polarization fir the radiating waves is available; (5) fed lines are fabricated simultaneously with fabrication of the remainder of the ms antenna; and (6) the choice of operating frequency may be chosen over a broad range from 100 MHz to 50 GHz. However, the ms antenna also has certain disadvantages: (1) the bandwidth for ms antenna operation is usually small, with a typical full width at half maximum (FWHM) of about 10 MHz; (2) an ms antenna has some loss so that gain is limited, usually to 20 dB or less; (3) except for special designs, an ms antenna usually radiates into a half plane and has poor endfire performance; (4) isolation between the feed line and the radiating element is a serious problem; (5) an ms antenna may excite surface waves as well; and (6) an ms antenna has relatively low power handling capability.

Dual frequency ms antenna have been discussed by Munson, op. cit., and by Bahl and Bhartia, op. cit., pp. 69–75, 127–132 and 157–162, and elsewhere in the literature within the last ten years. These dual frequency configurations usually employ a stacked ground plane and first and second patch resonators, spaced apart by two dielectric layers, with the first and second resonators each radiating at distinct resonant frequencies. Each patch resonator requires a separate feed line, and the two frequencies must differ from each other by at least 10–20 percent. The material for, and thickness of, the dielectric layer separating the first and second resonators must be carefully controlled to provide reasonable electromagnetic isolation of the resonators and their associated frequencies.

What is needed is a more compact dual frequency ms antenna that does not require fabrication of two electrically separated resonator regions and for which the dielectric materials and thicknesses used are not so critical in fabrication of the antenna. Preferably, the dual frequency antenna should allow use of a wide range of dielectric materials and should offer improved spatial directivity and FWHM bandwidth for the radiation fields.

SUMMARY OF THE INVENTION

These needs are met by apparatus provided by the invention, which uses a single electromagnetically radiating surface to receive or transmit two distinct microwave frequencies. The apparatus includes a substrate of dielectric material of selected thickness having first and second opposed surfaces. A first ground plane and (optional) second ground planes are provided on the first and second surfaces of the substrate, and a first thin layer of electrically conducting material is positioned in the interior of the substrate material, at selected distances from the first and second substrate surfaces. A second thin layer of electrically conducting material, formed as an annular strip of selected dimensions, is positioned on the first substrate surface, spaced apart from and surrounding the first ground plane. The two electrically conducting layers are electrically connected, and two signal feed lines are connected to the first of these layers. The first electrically conducting layer provides the higher of the two desired frequencies $f_1$, and the combination of the first and second conducting layer provides the lower of the two desired frequencies $f_2$.

The first and second electrically conducting layers and the first ground plane may be formed as squares, rectangles, polygons, circles or ovals, with different frequency response characteristics. In one embodiment of the apparatus, the FWHM bandwidth of the antenna is more than 20 MHz and the receiver sensitivity falls by less than 10 dB over an azimuthal angle range of −90° to +90°.

These and other advantages of the present invention will become apparent to those skilled in the art upon a reading of the following specification of the invention and a study of the several figures of the drawing.

DETAILED DESCRIPTION OF THE PREFERRED EMBODIMENTS

Figure 1:
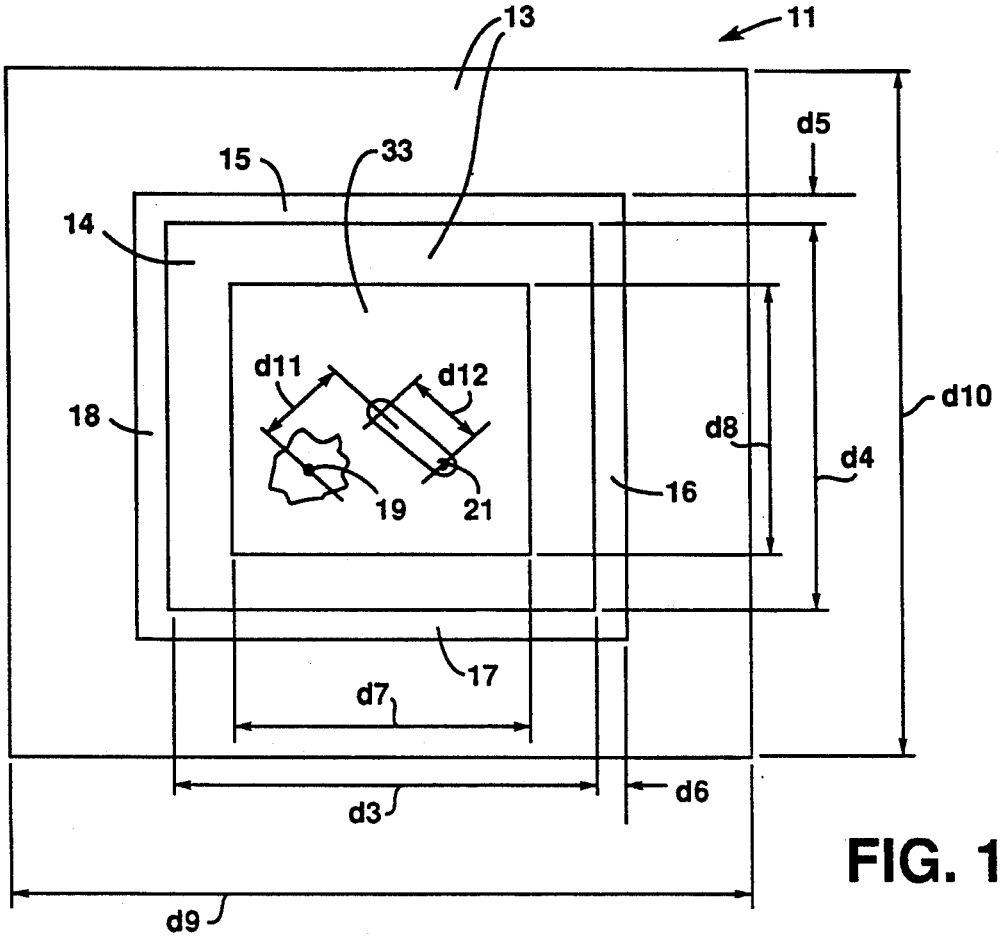
FIGS. 1 and 2 are top and side sectional views of an embodiment of the invention using a rectangular configuration.
Figure 2:
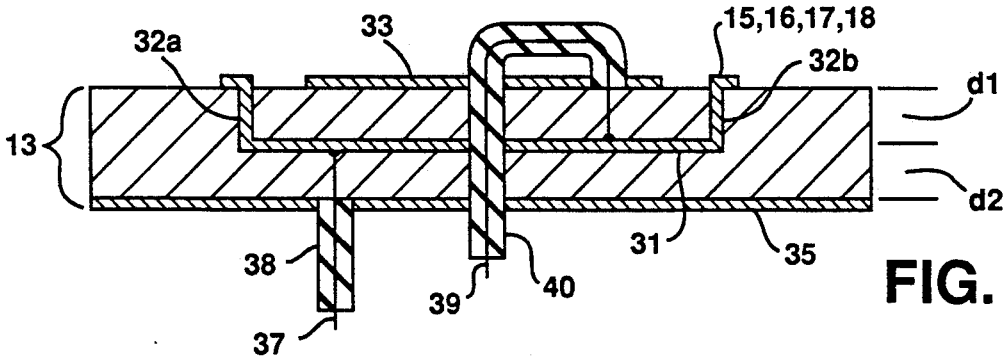

FIGS. 1 and 2 are top and side sectional views of one embodiment 11 of the invention. A substrate layer 13 of dielectric material of thickness d1+d2 is provided having first and second opposed surfaces. An annular strip consisting of four segments 15, 16, 17 and 18, joined at the corners to form a rectangle of electrically conducting material, is positioned on a first surface of the substrate. The strips 15 and 17 have length d3 and width d5. The strips 16 and 18 have length d4 and width d6, as shown. A rectangle 14 of the substrate 13 is enclosed by the strips 15, 16, 17 and 18. The dielectric substrate has area dimensions d9×d10, as shown. A thin, rectangular layer 31 of electrically conducting material of area dimensions approximately d7×d8 is positioned in the interior of the substrate 13 at distances d1 and d2, respectively, from the first and second surfaces of the substrate. The layer 31 is electrically connected to one or more of the electrically conducting strips 15, 16, 17 and 18 by conducting layers 32*a* and 32*b*.

A first ground plane 33, of rectangular form with dimensions d7×d8, is positioned on the first or front surface of the substrate 13 and is surrounded by and spaced apart from the rectangle formed by the strips 15, 16, 17 and 18. A second ground plane 35 is positioned on the second or back surface of the substrate 13 and may be formed as a rectangle of area dimensions d9×d10. A first signal feed line 37 is electrically connected to the conducting layer 31 at a position 19 on a rectangle diagonal and is electrically isolated from the first and second ground planes 33 and 35 by an insulating cable 38. A second signal feed line 39 is electrically connected to the conducting layer 31 on a second rectangle diagonal at a position 21 and is electrically isolated from the first and second ground planes 33 and 35 by an insulating cable 40. The signal feed line positions 19 and 21 are located at distances d11 and d12, respectively, from the center intersection point of the two rectangle diagonals for the conducting layer 31. More generally, the signal feed point positions 19 and 21 would lie along two diameters of, or be slightly displaced from diameters of, the conducting layer 31. The positions 19 and 21 are chosen to match the local impedance of the conducting layer 31 as closely as possible the 50 Ohm impedances for the two signal feed lines and for suppression of signals with the frequencies $f_2$ and $f_1$ at those respective positions. The first and second feed point positions 19 and 21 might also be chosen to approximately coincide with positions where a component of an oscillating electric field of the second frequency and of the first frequency, respectively, has a node or local minimum in intensity.

Inclusion of the second ground plane 35 is optional, and the dimensions d9 and d10 of this ground plane are not critical. The primary purpose for inclusion of the second ground plane 35 is to provide a means of shielding the conducting layer 31 from receipt of most bounce signals that approach the conducting layer 31 from the side or rear of the apparatus 11. Thus, if the ground plane 35 is included in the apparatus 11, it is preferable that the dimensions d9 and d10 of this ground plane be large enough that the conducting layer 31 is largely shielded from microwave signals approaching this layer from the rear by the second ground plane 37.

The dimensions of the conducting layer 31 and the distance d11 are chosen to enhance transmission or receipt of signals with the first desired frequency f1. The dimensions of the conducting layer 31 in combination with the strips 15, 16, 17 and 18, plus the distance d12, are chosen to enhance transmission or receipt of signals with the second desired frequency f2. For example, the following choices of dimensions are suitable for the two GPS frequencies $f_1=1.575$ GHz and $f_2=1.277$ GHz:

d1=d2=3.12 mm,
d3=6.03 cm,
d4=6.32 cm
d5=0.57 cm,
d6=0.40 cm,
d7=d8=5.09 cm,
d9=d10=10.00 cm,
d11=1.34 cm,
d12=1.59 cm.

The substrate 13 may be one layer or two layers and the dielectric material(s) for the substrate(s) preferably is low loss, with the real part of the relative dielectric coefficient at the frequency of interest satisfying $\epsilon_r \approx 2.6$ or 3.6 or 4.2 or 9.6 or 10.6.

Suitable materials for the conducting layer 31 and the ground planes 35 and 37 are Cu, Al, Sn and Ag.

Suitable dielectric materials for the substrate 13 include epoxy, polyimide, fluorinated ethylene propylene (Teflon) and aluminum ceramic. However, the preferred choice for this dielectric material is polyphenylene oxide resin, a thermosetting resin with a relative dielectric constant $\epsilon_r=3.35$ or 10.5. This dielectric material is discussed by M. Itoh et al in "Thermosetting PPO Laminates For High Frequency Circuits", presented at the Fall Meeting of the Institute for Interconnecting and Packaging Electronic Circuits, Oct. 24–28, 1988, Anaheim, Calif.

Choices of dimensions for the two GLONASS frequencies $f_1=1.602$ GHz and $f_2=1.246$ GHz are similar to those for the GPS frequencies. The Federal Communications Commission has made three frequency ranges available for LANs in the United States: f=0.902–0.928 GHz, f=2.400–2.485 GHz and f=5.725–5.850 GHz. Two frequencies, one drawn from each of two of these three ranges, would often be used for a wireless LAN. These frequency ranges are shared with other over-the-air products, such as security systems and selected consumer products. Different frequency ranges may be provided for wireless LAN communications in another country, but the dual frequency antenna of the invention will operate similarly in any country.

Figure 3:
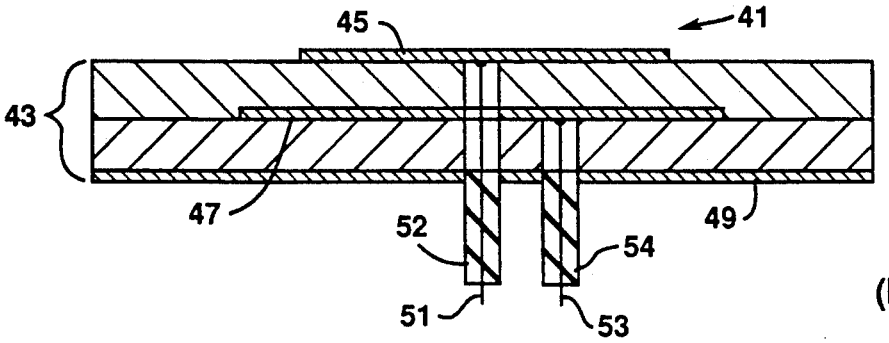
FIG. 3 (PRIOR ART)
FIG. 3 is a side sectional view of a dual frequency antenna from the prior art.

FIG. 3 is a side sectional view of a conventional dual frequency antenna 41. A dielectric substrate 43 with first and second opposing surfaces is provided. A first electrically conducting layer 45 is positioned on the first substrate surface, and a second electrically conducting layer 47 is positioned in the interior of the substrate 43. A ground plane 49 is positioned on the second surface of the substrate 43. First and second signal feed lines 51 and 53 are connected to the first and second conducting layers 45 and 47, respectively, and these feed lines are insulated from other components by insulating cables 52 and 54 as shown. The first and second conducting layers 45 and 47 are electrically isolated from each other, and these two layers are driven independently. FIG. 3 illustrates another, simpler approach for connecting the feed signal lines to the respective feed points on the conducting layers. This simpler approach can also be used to connect the two feed signal lines 37 and 39 (FIG. 2) to the conducting layer 31 in FIG. 1.

Figure 4:
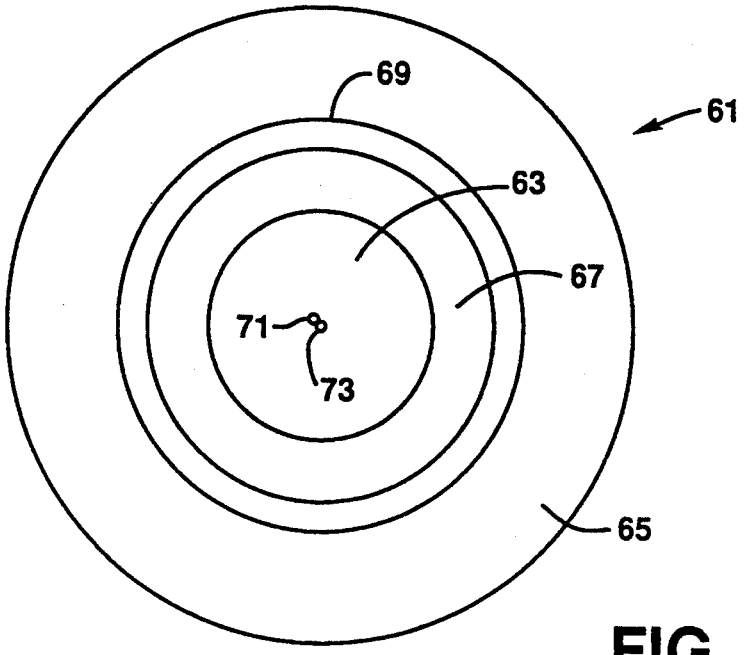
FIGS. 4 and 5 are top sectional views of embodiments of the invention in representative circular and polygonal configurations, respectively.

FIG. 4 is a top sectional view of an embodiment 61 of the invention that uses a circular, or more generally elliptical, annular geometry for receipt and/or transmission of signal at two distinct frequencies. A first circular ground plane 63 is positioned on a first surface of a dielectric substrate 69. A circular strip 69 of electrically conducting material is also positioned on the first substrate surface, surrounding and being spaced apart from the first ground plane 63 by a portion 67 of the substrate material as shown. An electrically conducting layer, coinciding in size with and lying beneath the regions 63 and 67, is positioned in the interior of the substrate 65 and is electrically connected with the circular ring or annulus 69. This electrically conducting layer plus the annular strip 69 provide the desired first and second frequencies at signal feed points 71 and 73, respectively. The dimensions of the components are defined analogously to the dimensions shown in FIGS. 1 and 2.

Figure 5:
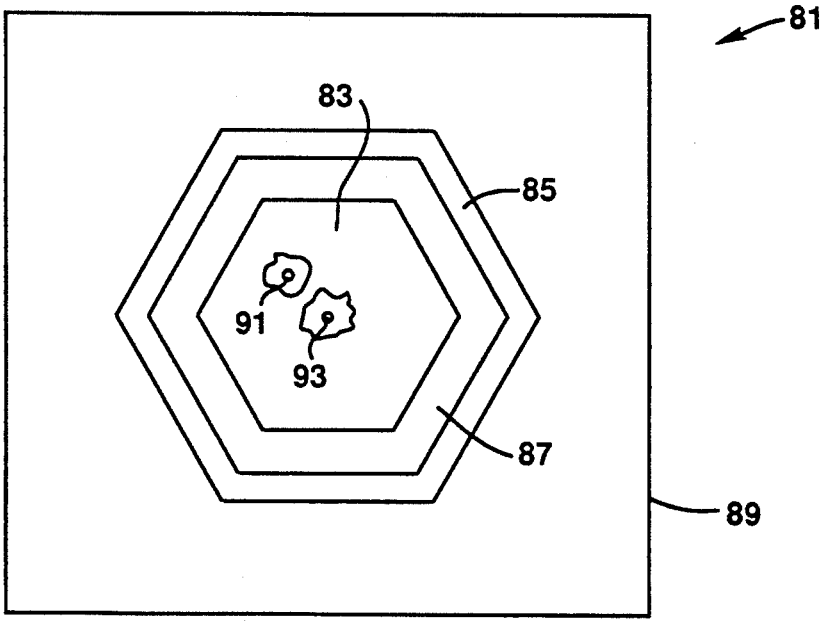

FIG. 5 is a top sectional view of an embodiment 81 of the invention that uses a polygonal annular geometry (hexagonal for illustration) for receipt and/or transmission of signal at two distinct frequencies. A first circular ground plane 83 is positioned on a first surface of a dielectric substrate 89. A polygonal strip 89 of electrically conducting material is also positioned on the first substrate surface, surrounding and being spaced apart from the first ground plane 83 by a portion 87 of the substrate material as shown. An electrically conducting layer, coinciding in size with and lying beneath the regions 83 and 87, is positioned in the interior of the substrate 85 and is electrically connected with the polygonal ring or annulus 89. This electrically conducting layer plus the annular strip 89 provide the desired first and second frequencies at signal feed points 91 and 93, respectively. The dimensions of the components are defined analogously to the dimensions shown in FIGS. 1 and 2. The annular conducting strip used in each of the embodiment illustrated in FIGS. 1, 4 and 5 has approximately constant width, measured in the plane of the first surface of the dielectric material, in a preferred embodiment.

Figure 6:
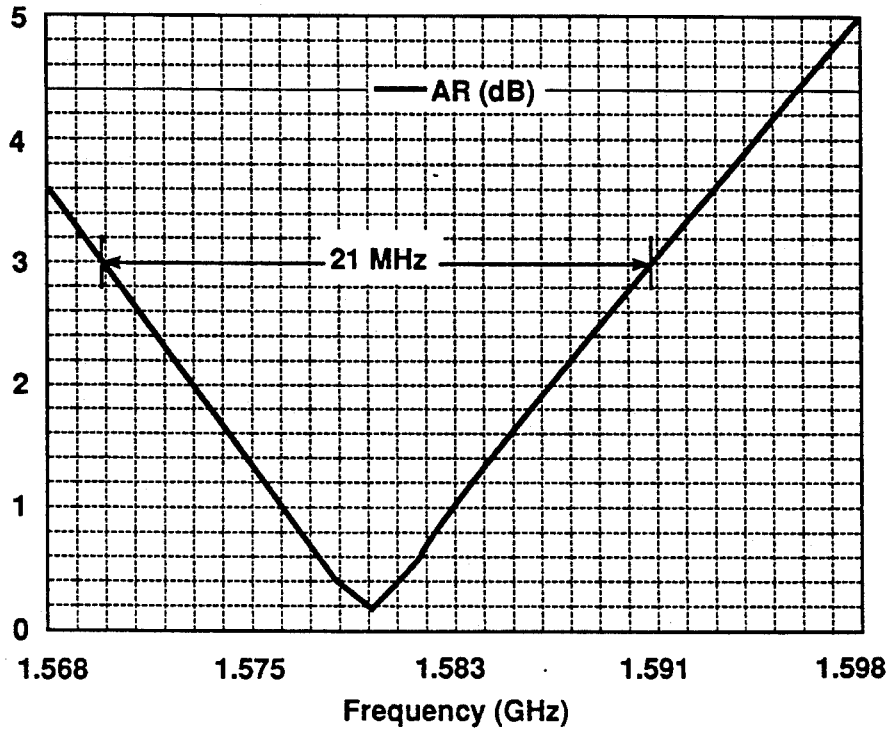
FIGS. 6 and 7 are graphical views illustrating variation of the calculated axial ratio (dB) of the GPS dual frequency antenna, constructed according to the invention, as frequency varies for the two frequencies $f_1=1.575$ GHz and $f_2=1.227$ GHz, respectively.
Figure 7:
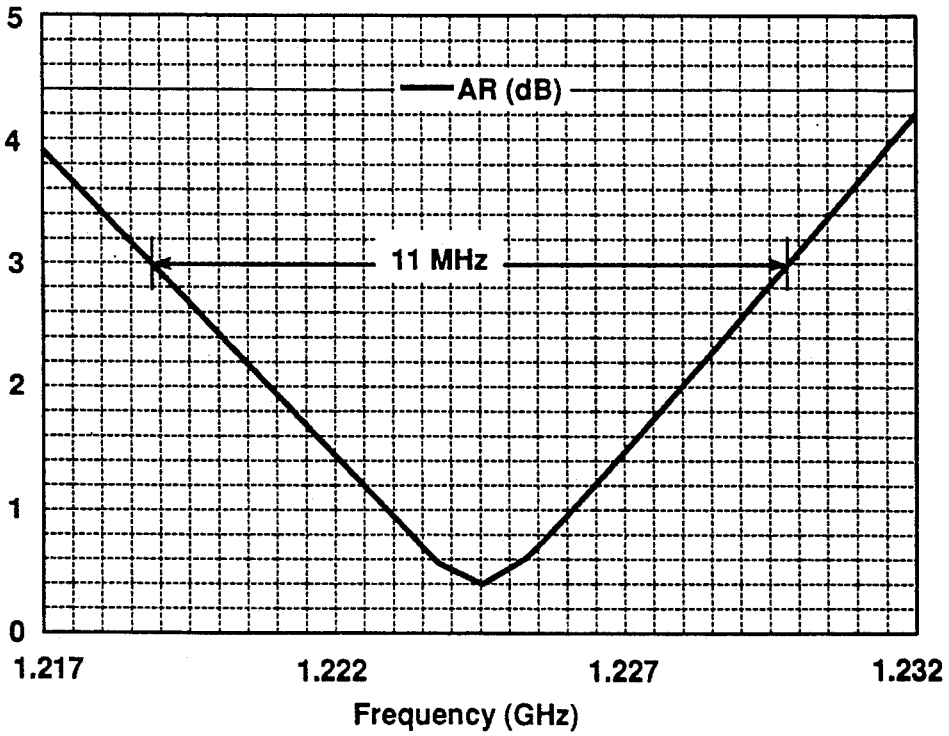
Figure 8:
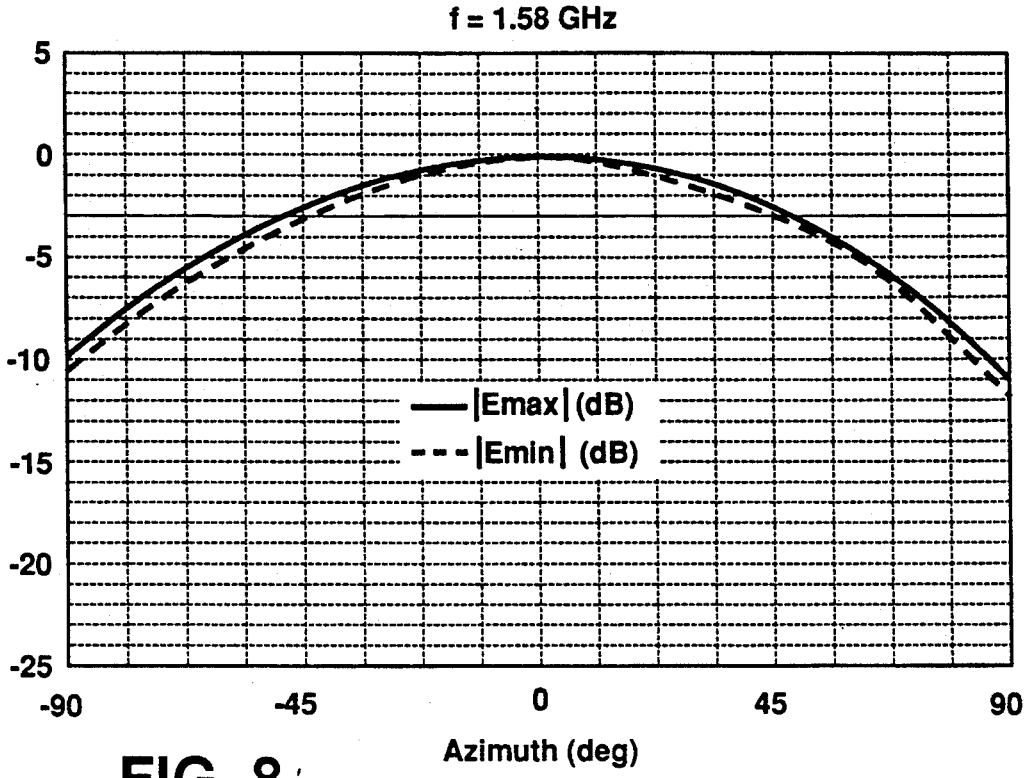
FIGS. 8 and 9 are graphical views illustrating variation of the calculated maximum electric field magnitude (dB) and minimum electrical field magnitude (dB) for the GPS dual frequency antenna, constructed according to the invention, as azimuthal angle for signal receipt varies for the two frequencies $f_1=1.575$ GHz and $f_2=1.227$ GHz, respectively.
Figure 9:
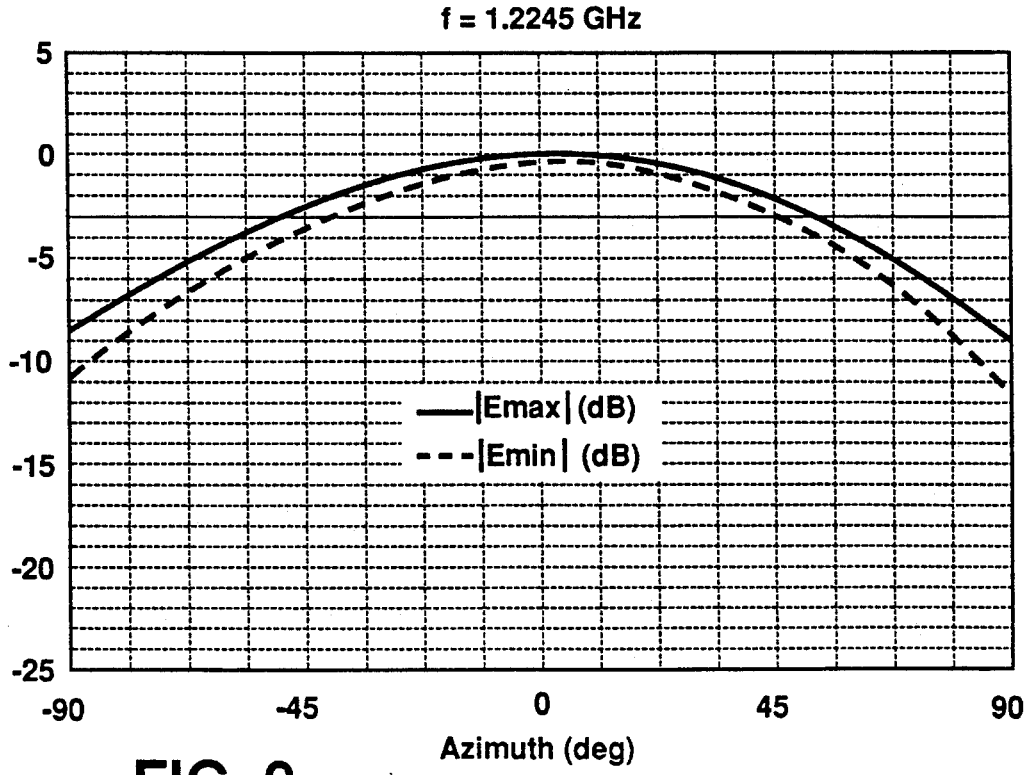

FIGS. 6 and 7 are graphical views of the calculated axial ratio (dB) of the GPS dual frequency antenna, with dimensions d1–d12 chosen as discussed above, as a function of frequency, for frequencies centered at or near $f=f_1=1.575$ GHz and $f=f_2 1.277$ GHz, respectively. The FWHM values for these two center frequencies are 0.021 GHz and 0.011 GHz, respectively. These FWHM values provide adequate tolerance for dual frequency operation. FIGS. 8 and 9 are graphical views of the calculated maximum electrical field magnitude $|E_{max}|$ (dB) and minimum electrical field magnitude $|E_{min}|$ (dB) for the frequencies $f=f_1$ and $f=f_2$, respectively, as a function of azimuthal angle for signal receipt, measured relative to the normal to the antenna plane. Ideally, these maximum and minimum magnitudes would agree for all azimuthal angles. Here, the agreement is adequate for dual frequency signal receipt and transmission.

While this invention has been described in terms of several preferred embodiments, it is contemplated that alterations, modifications and permutations thereof will become apparent to those skilled in the art upon a reading of the specification and study of the drawings. It is intended that the following appended claims include all alterations, modifications and permutations that fall within the spirit and scope of the present invention.

We claim:

1. Apparatus for receiving microwave signals having first and second distinct frequencies, the apparatus comprising:

a substrate of dielectric material having a selected substrate thickness and having opposed first and second surfaces;

a first grounded layer of electrically conducting material, positioned on the first surface of the substrate;

a first conducting layer of electrically conducting material, positioned on the first surface of the substrate and formed as an annular strip that surrounds and is spaced apart from the first grounded layer; and a second conducting layer of electrically conducting material, positioned in the interior of the substrate, facing and spaced apart from the first grounded layer, and electrically connected to the first conducting layer, said second conducting layer forming a solid, closed, substantially planar geometrical figure.

2. The apparatus of claim 1, further comprising:

a first signal receiver, electrically connected to said second conducting layer, for receiving a microwave signal having said first frequency; and a second signal receiver, electrically connected to said second conducting layer, for receiving a microwave signal having said second frequency.

3. The apparatus of claim 2, wherein said first and second signal receivers are connected to said second conducting layer at selected first and second positions, respectively, on said second conducting layer, wherein said first and second positions on said second conducting layer are chosen to enhance the reception and transmission of said signals having said first frequency and said second frequency, respectively.

4. The apparatus of claim 3, wherein said second conducting layer forms a substantially rectangular geometrical figure.

5. The apparatus of claim 4, wherein said first position and said second position are located on first and second diagonals, respectively, of said second conducting layer.

6. The apparatus of claim 1, wherein said annular strip has an inner perimeter and an outer perimeter and has a width, measured from its inner perimeter to its outer perimeter in a plane containing said first substrate surface, that is approximately uniform.

7. The apparatus of claim 1, wherein said second layer of electrically conducting material has a shape that is selected from the group consisting of a rectangle, an ellipse and a polygon.

8. The apparatus of claim 7, wherein said first conducting layer has an inner perimeter and an outer perimeter, and the inner perimeter has a shape that is selected from the group consisting of a rectangle, an ellipse and a polygon.

9. The apparatus of claim 1, wherein said first grounded layer and said second conducting layer have approximately the same shape.

10. The apparatus of claim 1, further comprising a second grounded layer of electrically conducting material, positioned on said second surface of said substrate so that said second conducting layer is positioned between and spaced apart from said first grounded layer and the second grounded layer.

11. The apparatus of claim 10, wherein said first and second opposed surfaces of said substrate are approximately parallel to each other and to said second conductive layer, and said second conductive layer is positioned approximately equidistant from said first surface and from said second surface of said substrate.

12. The apparatus of claim 1, wherein said dielectric material for said substrate is drawn from the group consisting of epoxy, polyimide, fluorinated ethylene propylene, alumina ceramic and polyphenylene oxide resin.

13. The apparatus of claim 1, wherein said first frequency and said second frequency are drawn from the frequency pairs consisting of (1.227 GHz, 1.575 GHz) and (1.246 GHz, 1.602 GHz).

14. The apparatus of claim 1, wherein said first frequency is chosen to lie in one of the three frequency ranges f=0.902–0.928 GHz, f=2.400–2.485 GHz and f=5.725–5.850 GHz, and said second frequency is chosen to lie in one of these three frequency ranges in which said first frequency does not lie.

15. The apparatus of claim 1, wherein said first and second frequencies are chosen to be approximately 1.575 GHz and 1.227 GHz, respectively, and said apparatus has an axial ratio, for frequencies adjacent to said first frequency, of no more than about 0.021 GHz.

16. The apparatus of claim 1, wherein said first and second frequencies are chosen to be approximately 1.575 GHz and 1.227 GHz, respectively, and said apparatus has an axial ratio, for frequencies adjacent to said second frequency, of no more than about 0.011 GHz.

17. Apparatus for receiving microwave signals having first and second distinct frequencies, the apparatus comprising:

a first substrate of dielectric material having a selected substrate thickness and having opposed first and second surfaces;

a second substrate of dielectric material having a selected substrate thickness and having opposed first and second surfaces, with the first surface of the second substrate and the second surface of the first substrate facing each other;

a first grounded layer of electrically conducting material, positioned on the first surface of the first substrate;

a first conducting layer of electrically conducting material, and formed as an annular strip that surrounds and is spaced apart from the first grounded layer; and a second conducting layer of electrically conducting material, positioned between and contiguous to the second surface of the first substrate and the first surface of the second substrate and electrically connected to the first conducting layer, said second conducting layer forming a solid, closed, substantially planar geometrical figure.

18. The apparatus of claim 17, further comprising:

a first signal receiver, electrically connected to said second conducting layer, for receiving a microwave signal having said first frequency; and a second signal receiver, electrically connected to said second conducting layer, for receiving a microwave signal having said second frequency.

19. The apparatus of claim 17, wherein said first and second signal receivers are connected to said second conducting layer at selected first and second positions, respectively, on said second conducting layer, wherein said first and second positions on said second conducting layer are chosen to enhance the reception and transmission of said signals having said first frequency and said second frequency, respectively.

20. The apparatus of claim 19, wherein said second conducting layer forms a substantially rectangular geometrical figure.

21. The apparatus of claim 20, wherein said first position and said second position are located on first and second diagonals, respectively, of said second conducting layer.

22. The apparatus of claim 17, wherein said annular strip has an inner perimeter and an outer perimeter and has a width, measured from its inner perimeter to its outer perimeter in a plane containing said first substrate surface, that is approximately uniform.

23. The apparatus of claim 17, wherein said first conducting layer of has a shape that is selected from the group consisting of a rectangle, an ellipse and a polygon.

24. The apparatus of claim 23, wherein said first conducting layer has an inner perimeter and an outer perimeter, and the inner perimeter has a shape that is selected from the group consisting of a rectangle, an ellipse and a polygon.

25. The apparatus of claim 17, wherein said first grounded layer and said second conducting layer have approximately the same shape.

26. The apparatus of claim 17, wherein said first surface of said first substrate and said second surface of said second substrate are approximately parallel to each other and to said second conducting layer, and said second conducting layer is positioned approximately equidistant from said first surface of said first substrate and from said second surface of said second substrate.

27. The apparatus of claim 17, further comprising a second grounded layer of electrically conducting material, positioned on said second surface of said second substrate so that said second conducting layer is positioned between and spaced apart from said first grounded layer and the second grounded layer.

28. The apparatus of claim 17, wherein said dielectric material for said first substrate is drawn from the group consisting of epoxy, polyimide, fluorinated ethylene propylene, alumina ceramic and polyphenylene oxide resin.

29. The apparatus of claim 17, wherein said dielectric material for said second substrate is drawn from the group consisting of epoxy, polyimide, fluorinated ethylene propylene, alumina ceramic and polyphenylene oxide resin.

30. The apparatus of claim 17, wherein said first frequency and said second frequency are drawn from the frequency pairs consisting of (1.227 GHz, 1.575 GHz) and (1.246 GHz, 1.602 GHz).

31. The apparatus of claim 17, wherein said first frequency is chosen to lie in one of the three frequency ranges f=0.902–0.928 GHz, f=2.400–2.485 GHz and f=5.725–5.850 GHz, and said second frequency is chosen to lie in one of these three frequency ranges in which said first frequency does not lie.

32. The apparatus of claim 17, wherein said first and second frequencies are chosen to be approximately 1.575 GHz and 1.227 GHz, respectively, and said apparatus has an axial ratio, for frequencies adjacent to said first frequency, of no more than about 0.021 GHz.

33. The apparatus of claim 17, wherein said first and second frequencies are chosen to be approximately 1.575 GHz and 1.227 GHz, respectively, and said apparatus has an axial ratio, for frequencies adjacent to said second frequency, of no more than about 0.011 GHz.

34. Apparatus for receiving and transmitting microwave signals having first and second distinct frequencies, the apparatus comprising:

a grounded layer of electrically conducting material, defining a first plane;

a first conducting layer of electrically conducting material, positioned substantially within said first plane and formed as an annular strip that surrounds and is spaced apart from the grounded layer;

a second, substantially solid conducting layer of electrically conducting material defining a second plane spaced apart and substantially parallel to said first plane, said second conducting layer being electrically connected to the first conducting layer; and substrate means made from a dielectric material which separates said grounded layer and said first conducting layer from said second conducting layer, said substrate means physically supporting said grounded layer, said first conducting layer, and said second conducting layer;

such that said second conducting layer, in conjunction with said first conducting layer, enhances the reception and transmission of a signal comprising a first distinct frequency and a second distinct frequency.

* * * * *